US009056464B2

(12) United States Patent
Chappell et al.

(10) Patent No.: US 9,056,464 B2
(45) Date of Patent: Jun. 16, 2015

(54) SYSTEM AND METHOD FOR OPTIMIZED APPLICATION OF RELEASE AGENT IN AN INKJET PRINTER WITH IN-LINE COATING

(71) Applicant: Xerox Corporation, Norwalk, CT (US)

(72) Inventors: James Michael Chappell, Webster, NY (US); Jason Matthew LeFevre, Penfield, NY (US); Paul J. McConville, Webster, NY (US); Rachael L. McGrath, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 1 day.

(21) Appl. No.: 13/943,215

(22) Filed: Jul. 16, 2013

(65) Prior Publication Data

US 2015/0022570 A1 Jan. 22, 2015

(51) Int. Cl.

| | |
|---|---|
| ***B41J 2/01*** | (2006.01) |
| ***B41J 2/125*** | (2006.01) |
| ***B41J 29/46*** | (2006.01) |
| ***B41J 11/00*** | (2006.01) |

(52) U.S. Cl.
CPC *B41J 2/125* (2013.01); *B41J 29/46* (2013.01); *B41J 11/0015* (2013.01)

(58) Field of Classification Search
CPC ..... B41J 2/17593; B41J 11/0015
See application file for complete search history.

(56) References Cited

U.S. PATENT DOCUMENTS

| | | | | |
|---|---|---|---|---|
| 6,176,575 | B1 | 1/2001 | Crawford et al. | |
| 6,884,054 | B2 * | 4/2005 | Shimada | 425/107 |
| 8,220,918 | B2 | 7/2012 | Chappell et al. | |
| 8,303,102 | B2 | 11/2012 | Fioravanti et al. | |
| 2001/0002553 | A1 * | 6/2001 | Willigen | 73/861.12 |
| 2003/0101825 | A1 * | 6/2003 | Neubert | 73/861.12 |
| 2003/0223788 | A1 * | 12/2003 | Tateishi et al. | 399/325 |
| 2005/0110854 | A1 * | 5/2005 | Roof et al. | 347/103 |
| 2007/0146459 | A1 * | 6/2007 | Gault et al. | 347/103 |
| 2009/0301218 | A1 | 12/2009 | Budmiger et al. | |
| 2010/0012023 | A1 * | 1/2010 | LeFevre et al. | 118/46 |
| 2010/0020148 | A1 * | 1/2010 | Gervasi et al. | 347/99 |
| 2010/0178087 | A1 | 7/2010 | Derimiggio | |
| 2010/0231674 | A1 * | 9/2010 | Domoto et al. | 347/103 |
| 2011/0149001 | A1 | 6/2011 | Chappell et al. | |
| 2012/0256979 | A1 | 10/2012 | Gordon et al. | |
| 2013/0027454 | A1 * | 1/2013 | Roof et al. | 347/14 |

FOREIGN PATENT DOCUMENTS

| | | |
|---|---|---|
| EP | 2 207 066 A1 | 7/2010 |

* cited by examiner

*Primary Examiner* — Shelby Fidler
(74) *Attorney, Agent, or Firm* — Maginot Moore & Beck LLP

(57) ABSTRACT

An inkjet printer and method therefore including a detector to monitor a quantity of release agent applied to a spreader drum. The inkjet printer includes a drum maintenance unit which applies the release agent to the spreader drum with a metering device, such as a metering blade, and determines a flow rate of unused release agent returned to a release agent sump. The determined flow rate of release agent provides a determination of the quantity of release agent applied to the spreader drum. Upon the determination that too much release agent has been applied based on the flow rate, an alert signal is generated indicating that the metering blade should be inspected and replaced if necessary. Monitoring the amount of release agent applied to the spreader drum in this way enables a more robust printing and in-line coating system.

2 Claims, 6 Drawing Sheets

SYSTEM AND METHOD FOR OPTIMIZED APPLICATION OF RELEASE AGENT IN AN INKJET PRINTER WITH IN-LINE COATING

TECHNICAL FIELD

The present disclosure relates generally to inkjet printing system for imaging a continuous web of media with phase change inks. In particular, the present disclosure relates to the application (via a Drum Maintenance Unit (DMU)) of a release agent to a spreader drum. The function of the spreader drum is to provide a level of image permanence as well as enable adequate image quality. The function of the DMU is to apply a release agent to the spreader drum surface which, when functioning properly, will prevent ink offset to the spreader drum surface from occurring.

BACKGROUND

In general, inkjet printing machines or printers include at least one printhead unit that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the printhead onto media or an imaging member. Such printheads can generate temperatures of approximately 110 to 120 degrees Celsius. Once the ejected ink is on media, the ink droplets solidify. The printhead unit ejects ink from a plurality of inkjet nozzles, also known as ejectors.

The media used in both direct-to-paper and offset (transfix) printers can be in web form. In a web printer, a continuous supply of media, provided in the form of a roll, is entrained onto rollers that are driven by motors. The motors and rollers pull the web from the supply roll through the printer to a take-up roll. Rollers are arranged along a linear media path, and the media web moves through the printer along the media path. As the media web passes through a print zone opposite the printhead or heads of the printer, the printheads eject ink onto the web.

Inkjet printers use solid ink or phase change ink, after printing the solidified ejected ink is warmed by a heater to soften or melt the ink on the media. The melted ink is then fixed to the media by a pressurized nip formed by a spreader drum, which includes a hard surface or non-conformable surface, and pressure roller, which includes a compressible surface. An oil, also known a release agent, is deposited on the surface of the spreader drum and is spread by a metering device, typically a urethane metering blade. As the media with softened ink moves through the nip, the oil on the surface of the spreader drum prevents the compressed ink from offsetting to the spreader drum. After the media image has been compressed to fix the image to the media, the media can be directed to finishing equipment which applies a coating/varnish, such as a latex based coating, which provides a protective barrier to the deposited ink and which can also provide a selected finish, such as a glossy finish, to the final documents. The finishing equipment also cuts the continuous web into sheets.

Existing continuous web phase change inkjet printing systems combined with in-line coating systems can perform inadequately when an excessive quantity of release agent remains on the surface of an image moving through the pressurized nip. Even though the image moves through the nip for a relatively short period of time, typically a fraction of a second, for instance milliseconds, an excessive quantity of release agent can remain. In some instances, the excessive quantity of release agent is caused by a worn metering blade found in a drum maintenance unit (DMU) of the printer. If the blade is sufficiently worn, the DMU can leave too much release agent on the Spreader drum. The worn metering blade thereby supplies too much oil to the surface of the spreader drum and consequently the printed media/image. This in turn results in poor wettability of the in-line coating solution to the media/image. If the In-line coating is improperly wetted due to an excessive quantity of release agent, the in-line coating, typically a latex coating/varnish, is not spread evenly across the image but instead is spread unevenly such that some areas of the image include little or no latex coating/varnish and other areas include too much latex coating/varnish. Consequently, the images are less durable than needed, thereby resulting in degraded durability performance. In such systems, the system delivering the release agent to the spreader drum is not sufficiently robust to deliver the required quantity of release agent at the rates and duty cycle demands.

Another failure mode occurs when the quantity of release agent is insufficient to adequately coat the surface of the spreader drum. In such a situation, the final product suffers from an objectionable product failure rate which is caused by ink offsetting to the spreader drum due to inadequate continuous supply of release agent to the spreader drum surface. Under these conditions, the images which appear on the continuous web can be incomplete, uneven, or smudged.

In one known embodiment, the method for monitoring the application of release agent to the spreader drum is to print a specific test target and perform a physical analysis of the printing system based on the test target, to thereby determine the concentration of release agent being applied. This method requires printing a sample of a known image, which is not part of a customer print job. The printed known image must then be removed from the customer workflow and typically sent offsite for analysis, the results of which can often take days. Consequently, customer workflow can be interrupted for an undesirable period of time, especially since there is a low probability that the problem can be identified in time to prevent a printer failure. This is because a failure of the printer can occur within minutes or hours after it is determined that a physical analysis of the printing system should be made to identify a problem. If a problem related to the application of the release agent is not detected prior to or near the onset of the problem, failures can result leading to unacceptable downtime, labor intensive cleaning and/or replacement of damaged components. Consequently, improvements to a printing system and to printing images by taking into account the application of release agent to the spreader drum, the quantity of release agent being deposited on the continuous web, and conditions occurring in the printer during periods of non-printing or non-use are desirable.

SUMMARY

The present disclosure describes a system and method for optimizing the application of a release agent to a spreader drum for inline coating of a continuous web in an inkjet printer. The system and method include monitoring the return rate of a release agent delivered to a sump of a release agent supply system. The release agent return rate is monitored by a sensor, which in one embodiment is located at the sump. When an output of the sensor does not satisfy a predetermined value or is outside a range of values, an inkjet printer controller provides a warning message to an operator and/or performs a printing system shutdown. In one embodiment, the predetermined range comprehends both an "upper-limit" beyond which in-line coating wettability is negatively impacted as well as a "lower-limit" below which heated ink-offsetting occurs. When the predetermined value or range of values is not satisfied, a fault condition is detected whereby maintenance procedures can be initiated to restore the release agent supply system to proper operation.

A printing system includes a printhead configured to deposit phase change ink on a continuous web of recording media in response to image data, a spreading apparatus, a metering device, and a release agent apparatus. The spreading apparatus includes a spreader drum and pressure roper defining a pressurized nip through which the continuous web moves, wherein the phase change ink deposited on the continuous web is fixed to the continuous web at the pressurized nip. The metering device is disposed adjacent the spreader drum. The release agent apparatus includes a reservoir configured to deliver a release agent along a supply path to the spreader drum, wherein the metering device is configured to apply a film of release agent on the spreader drum and to direct surplus release agent along a return path to the reservoir. The release agent apparatus includes a flow rate detector disposed at the return path and is configured to determine an excessive flow rate of the surplus release agent.

A method of applying a release agent with a metering device to a spreader drum of an inkjet printer, wherein the inkjet printer is configured to image a continuous web of recording media moving at a transport speed and having phase change ink deposited thereon to form images, includes determining a quantity of release agent to be applied to the spreader drum. The method further includes applying the quantity of the release agent to the spreader drum, applying the release agent on the spreader drum with the metering device, collecting surplus release agent spread by the metering device, determining a flow rate at which the surplus release agent is collected, and generating an alert signal if the determined flow rate exceeds a predetermined flow rate value.

DETAILED DESCRIPTION

Figure 1:
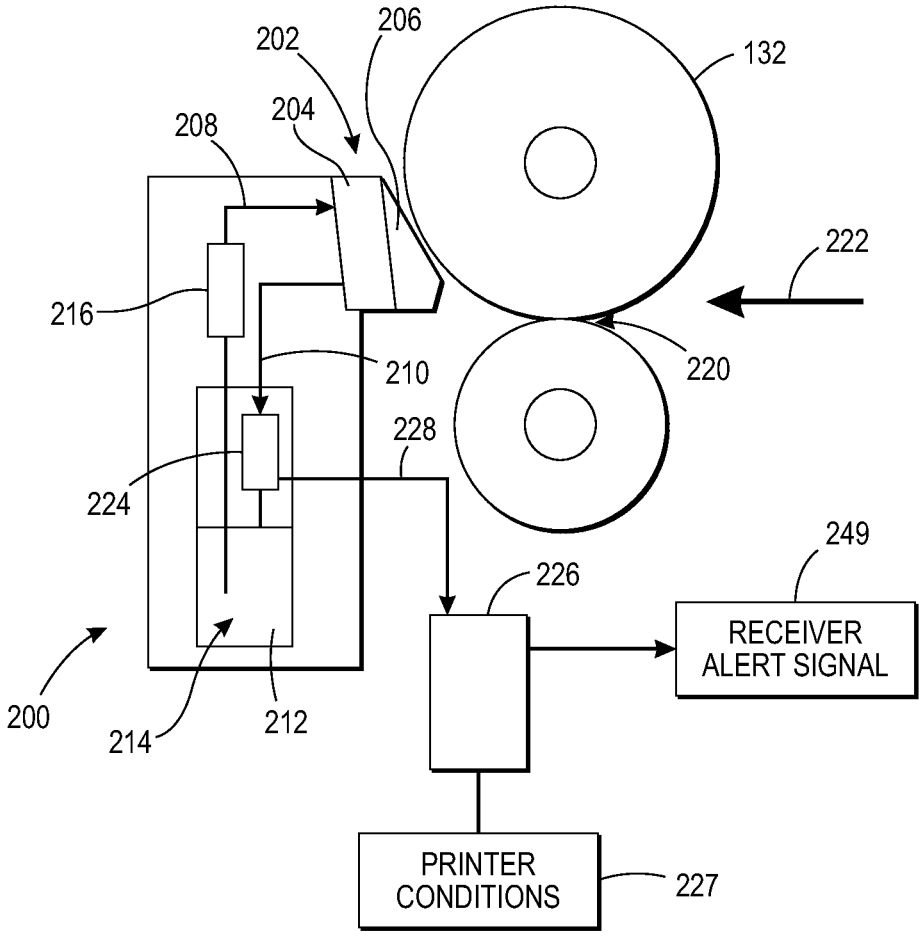
FIG. 1 is schematic diagram of a release agent application system configured to deposit release agent on a spreader drum and subsequently transfer that release agent to a continuous web recording media in an inkjet printer. The inkjet printer can be coupled In-line with a post-processing over-coating station.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous web of recording media" refer to an elongated print medium that is longer than the length of a media path that the web moves through a printer during the printing process. Examples of media webs include rolls of paper or polymeric materials used in printing. The media web has two sides having surfaces that are each configured to receive images during printing. The printed surface of the media web is made up of a grid-like pattern of potential drop locations, sometimes referred to as pixels.

As used herein, the term "roller" refers to a cylindrical member configured to have continuous contact with the media web moving over a curved portion of the member, and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members can be represented as: $v=2\pi r\omega$ where r is the radius of the member and $\omega$ is the rotational or angular velocity of the member.

Figure 9:
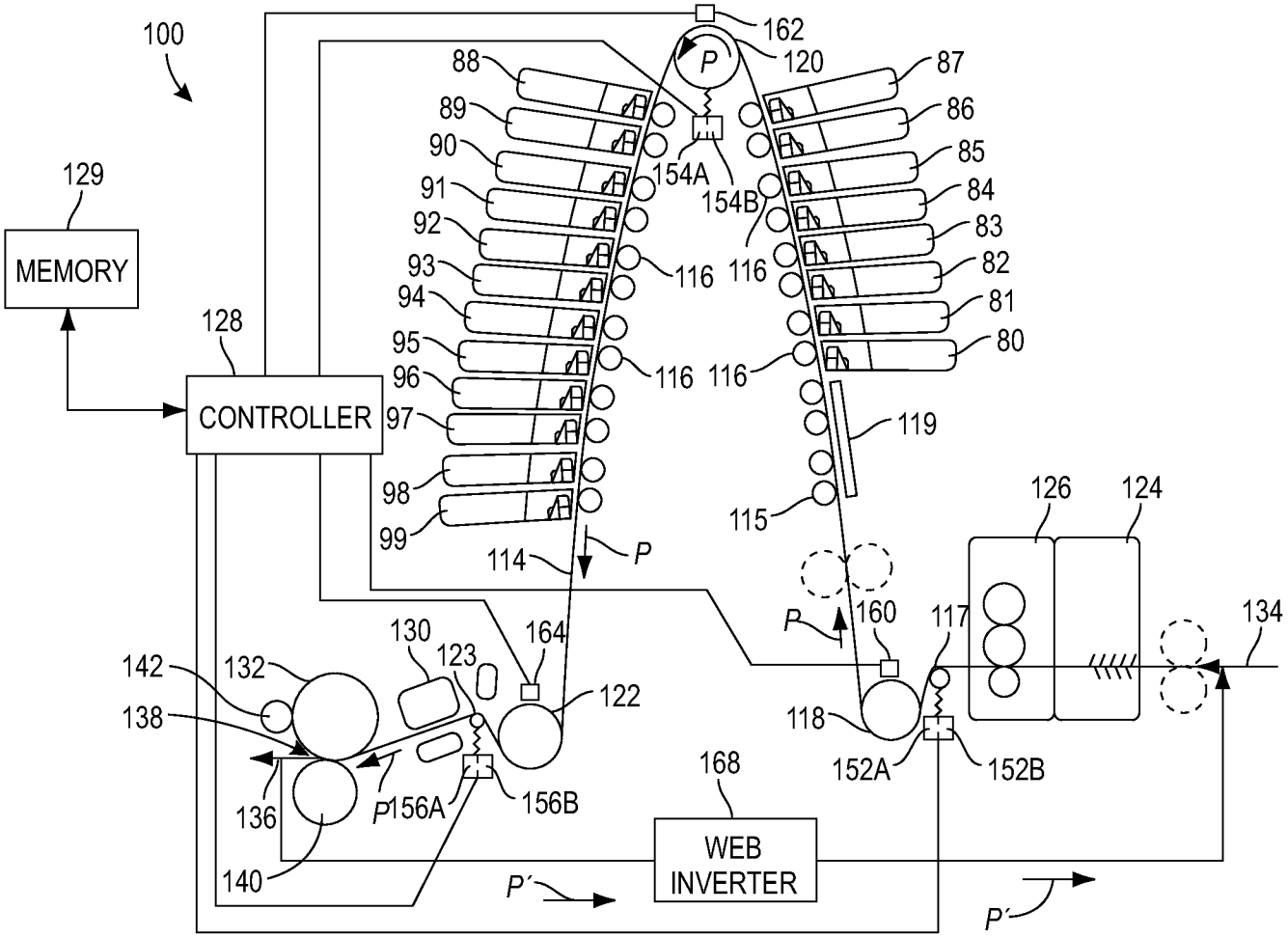
FIG. 9 PRIOR ART
FIG. 9 is a schematic view of a prior art inkjet printing system that images a continuous web of media as the media advances past the printheads of the printing system.

FIG. 9 depicts a prior art inkjet printer 100 having elements pertinent to the present disclosure. In the embodiment shown, the printer 100 implements a solid (phase change) ink print process for printing onto a continuous media web. Although a system and method for optimized release agent output for in-line coating are described below with reference to the printer 100 depicted in FIG. 9, the subject method and apparatus disclosed herein can be used in any printer, such as a cartridge inkjet printer, which uses serially arranged printheads to eject ink onto a continuous web image substrate.

FIG. 9 depicts a continuous web printer system 100 that includes twenty print modules 80-99, a controller 128, a memory 129, guide roller 115, guide rollers 116, pre-heater roller 118, apex roller 120, leveler roller 122, tension sensors 152A-152B, 154A-154B, and 156A-156B, and velocity sensors, such as encoders 160, 162, and 164. The print modules 80-99 are positioned sequentially along a media path P and form a print zone from a first print module 80 to a last print module 99 for forming images on a print medium 114 as the print medium 114 travels past the print modules. Each print module 80-83 provides a magenta ink. Each print module

84-87 provides cyan ink. Each print module 88-91 provides yellow ink. Each print module 92-95 provides black ink. Each print module 96-99 provides a clear ink as a finish coat. In all other respects, the print modules 80-99 are substantially identical.

The media web travels through the media path P guided by rollers 115 and 116, pre-heater roller 118, apex roller 120, and leveler roller 122. A heated plate 119 is provided along the path adjacent roller 115. In FIG. 9, the apex roller 120 is an "idler" roller, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader drum 132 are located at the opposite end 136 of the media path P.

The spreader drum 132 generates a pressurized nip 138 with a pressure roller 140 disposed adjacently to the spreader drum 132. A drum maintenance unit 142 located adjacently to the spreader roller 132, delivers a release agent, typically silicone oil, to the spreader drum 132 to enable fixing of the phase change ink to the continuous web. As the imaged continuous web moves through the heater 130, the phase change ink is heated such that the ink image is melted (or softened) before the continuous web enters the pressurized nip 138. The phase change ink is flattened to the continuous web while passing through the pressurized nip 138. The release agent applied to the spreader drum 132 prevents the heated ink from offsetting from the continuous web to the surface of spreader drum. In some embodiments, the spreader drum 132 is also heated to maintain the heated state of the phase change ink when entering the nip 138.

A web inverter 168 is configured to direct the media web 114 from the end 136 of media path P to the beginning 134 of the media path through an inverter path P'. The web inverter 168 flips the media web and the inverter path P' returns the flipped web to the inlet 134 to enable single-engine ("Mobius") duplex printing where the print modules 80-99 form one or more ink images on a second side (second side ink image) of the media web after forming one or more images on the first side (first side ink image). In this operating mode, a first section of the media web moves through the media path P in tandem with a second section of the media web, with the first section receiving ink images on the first side of the media web and the second section receiving ink images on the second side. This configuration can be referred to as a "mobius" configuration. Each of the print modules 80-99 is configured to eject ink drops onto both sections of the media web. Each of the rollers 115, 116, 118, 120, and 122 also engage both the first and second sections of the media web. After the second side of the media web 114 is imaged, the media web 114 passes the end of the media path 136. Registration of a second side ink image to a first side ink image forms a duplex image. In another embodiment, one print module is configured to span the width of the recording media, such that two print modules located side by side are used to eject ink on the first and second sections of the web.

As illustrated in FIG. 9, each of the print modules 80-99 includes an array of printheads that are arranged across the width of both the first section of web media and second section of web media. Ink ejectors in each printhead in the array of printheads are configured to eject ink drops onto predetermined locations of both the first and second sections of media web 114.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 80-99. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also hold one or more values that identify tension levels for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Encoders 160, 162, and 164 are operatively connected to preheater roller 118, apex roller 120, and leveler roller 122, respectively. Each of the encoders 160, 162, and 164 are velocity sensors that generate an angular velocity signal corresponding to an angular velocity of a respective one of the rollers 120, 118, and 122. Typical embodiments of encoders 160, 162, and 164 include Hall effect sensors configured to generate signals in response to the movement of magnets operatively connected to the rollers and optical wheel encoders that generate signals in response to a periodic interruption to a light beam as a corresponding roller rotates. Controller 128 is operatively connected to the encoders 160, 162 and 164 to receive the angular velocity signals. Signals from the encoders 160, 162 and 164 in combination with image data used by the printheads to generate image is received by the controller 128 to monitor the location of images on the continuous web if necessary. Controller 128 can include hardware circuits, software routines, or both, configured to identify a linear velocity of each of the rollers 120, 118, and 122 using the generated signals and a known radius for each roller.

Tension sensors 152A-152B, 154A-154B, and 156A-156B are operatively connected to a guide roller 117, apex roller 120, and post-leveler roller 123, respectively. The guide roller 117 is positioned on the media path P prior to the preheater roller 118. The post-leveler roller 123 is positioned on the media path P after the leveler roller 122. Each tension sensor generates a signal corresponding to the tension force applied to the media web at the position of the corresponding roller. Each tension sensor can be a load cell configured to generate a signal that corresponds to the mechanical tension force between the media web 114 and the corresponding roller.

In FIG. 9 where two sections of the media web 114 engage each roller in tandem, each of the tension sensors are paired to identify the tension on each section of the media web 114. In embodiments where one surface of the media web engages each roller, a single tension sensor can be used instead. Tension sensors 152A-152B generate signals corresponding to the tension on the media web 114 as the media web 114 enters the print zone passing print modules 80-99. The print zone is also known as the ink application zone or the "jetting zone." Tension sensors 154A-154B generate signals corresponding to the tension of the media web around apex roller 120 at an intermediate position in the print zone. Tension sensors 156A-156B generate signals corresponding to the tension of the media web around leveler roller as the media web 114 exits the print zone. The tension sensors 152A-152B, 154A-154B, and 156A-156B are operatively connected to the controller 128 to enable the controller 128 to receive the generated signals and to monitor the tension between apex roller 118 and the media web 114 during operation.

In the prior art system 100 utilizing a phase change or solid ink inkjet printing direct to media process, ink is jetted directly to the continuous web at speeds that can exceed five hundred feet per minute. The ink is then spread and fixed by the application of heat provided by the heater 130 and pressure provided at the pressurized nip 138. A sufficient quantity of release agent is applied by the maintenance unit 142 to prevent the heated ink from transferring (also known as offsetting) from the continuous web to the surface of the spreader drum 132.

Referring now to FIG. 1, the prior art printer system 100 is modified to include a release agent "sensing" apparatus 200 to monitor the return rate of the release agent and which is operatively connected to a drum maintenance unit 202 which includes a release agent dispenser 204 and a metering device 206. In other embodiments, the release agent dispenser 204 and the metering device 206 are considered to be part of the release agent apparatus 200. In still other embodiments, the release agent apparatus 200, the release agent dispenser 204 and the metering device 206 are collectively known as the drum maintenance unit. (DMU). In one embodiment, the metering device 206 is a metering blade.

For ease of discussion, however, and to illustrate the different features of the described embodiments, the release agent "sensing" apparatus 200 is operatively connected to the drum maintenance unit 202 through a supply line 208 and a return line 210. A sump 212 defines a reservoir in which release agent 214, also known as release oil or merely oil, is stored for application to the spreader drum 132. As can be seen, the sump 212 receives surplus release agent from the DMU 202 over the return line 210. The supply line 208 draws release agent 214 from the sump 212 by means of a supply pump 216 which supplies release agent to the release agent dispenser 204. In one embodiment, the release agent dispenser is a hollow tube including a plurality of apertures aligned along the length of the tube, each of which deposit or weep release agent onto the surface of a foam roller which then applies it to the spreader drum 132. The metering blade 206 is disposed adjacent to the surface of the spreader drum 132 and meters a thin layer of release agent 214 upon the surface of the spreader drum 132. Release agent is applied to the spreader drum 132 which in turn transfers the release agent to the media/image. Release agent that is deposited on media by the spreader drum 132 proceeds to exit the print engine, where the release agent can affect the wetting performance of an in-line coating system, which is located outside the print engine.

Factors such as urethane stiffness, blade free-length, and blade thickness, can influence the amount (thickness) of the oil film applied to the spreader drum. In addition, the age of the blade (i.e. the amount of wear the blade edge or tip has experienced) can affect the amount of oil applied to the spreader drum. Any surplus release agent contacts a side of the metering blade 206 and is directed to the sump over the return line 210. While the return line 210 is illustrated as passing through the oil feeder 204, other locations of the return line 210 are possible.

The return line 210 is operatively connected to a flow rate detector 224 through which the release agent 214 flows and where the release agent 214 returns to the sump 212. The flow rate detector 224 determines the flow rate of the release agent 214 being returned from the metering blade 206.

Figure 2:
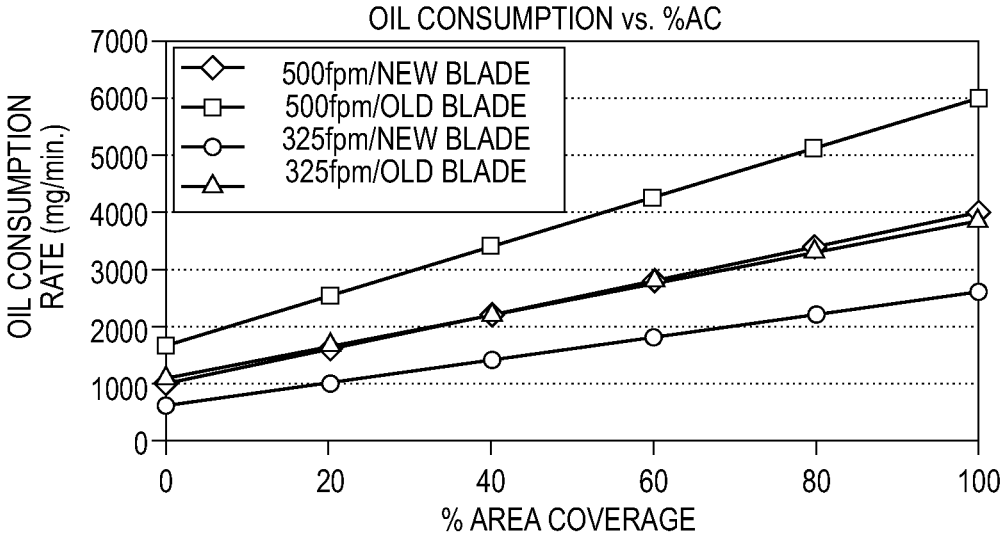
FIG. 2 is a graph representing oil consumption used by a spreader drum versus area coverage of ink and web speed.

The quantity of oil used or consumed during printing depends on a number of factors, one of which is percent area coverage (% A/C) as illustrated in the graph of FIG. 2. As seen in FIG. 2, not only does the rate of oil consumption vary based on the percent area coverage, the rate of oil consumption depends on a transport speed of the continuous web and the life of the metering blade. For instance, with a new metering blade, less oil is consumed than is consumed with an old metering blade. This relationship generally remains the same at different transport speeds of the web.

Figure 3:
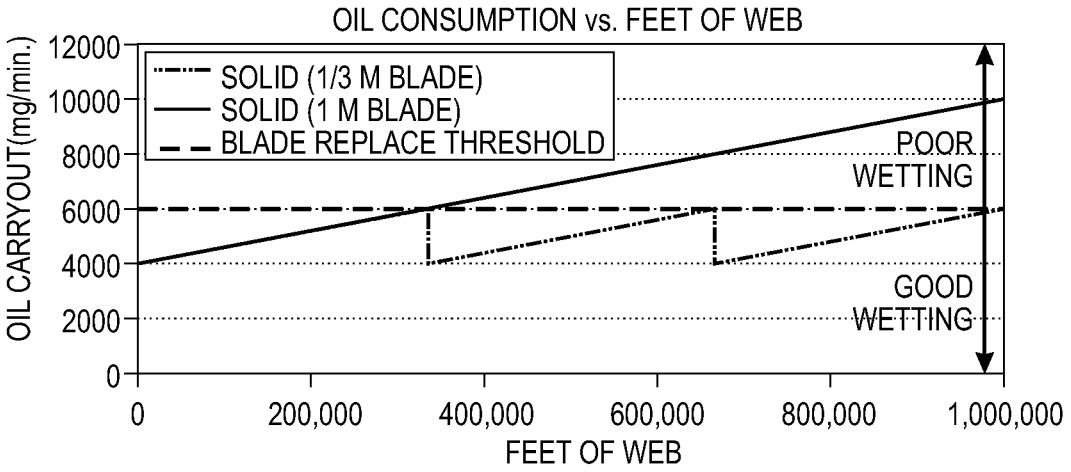
FIG. 3 is a graph representing oil consumption used by a spreader drum versus a quantity of continuous web.

As further illustrated in the graph of FIG. 3, the oil consumption rate over a period of time based on the number of linear feet of the web being imaged increases as the number of linear feet of web being imaged increases. FIG. 3 also illustrates a threshold of oil consumption above which the quantity of release agent begins to cause problems with "wettability" in in-line coating systems. For instance, oil consumption above 6000 milligrams (mg) per minute results in too much oil being applied to the surface of the spreader drum and consequently the printed media/image. This in turn results in poor wettability of the In-line coating solution to the printed media/image. Below 6000 mg/sec good wetting of the in-line coating solution occurs, which substantially reduces or eliminates image durability failures. As can be further seen, the oil consumption rate crosses the threshold at approximately 350,000 feet of imaged web. To return the oil consumption to a desired value, below the threshold, the metering blade is changed at that distance. In one embodiment, by replacing the metering blade three times over the imaging of a million feet of continuous web, good wetting is achieved.

As can be seen from the graphs of FIGS. 2 and 3, the percent area coverage, the age of the blade, the feet of the web being processed and the engine speed affects oil consumption which is indicative of system operability and printing performance and ability to have good in-line coating performance.

To maintain the proper quantity of release agent consumption and as illustrated in FIG. 1, a control system including the flow rate detector 224 and a controller 226 which is operatively connected to the flow rate detector 224 monitors the return flow rate of release agent 214 to the sump 212. The controller 226 in one embodiment is embodied within a printer controller such as the controller 128 of the printer 100 of FIG. 9. In another embodiment, the controller 226 is embodied as a standalone controller either separate from the printer controller or as a part of the release agent apparatus 200. The controller 226 is configured to process input information including printer conditions 227 in order to predict an optimal quantity of release agent to prevent hot ink offsetting from the web to the heated spreader drum surface of the spreading apparatus which includes the spreader drum 132 and pressure roller 140. The controller 226 processes printer conditions including feed forward image pixel information, web speed, and the age of the metering blade 206 as well information provided by the flow rate detector 224 of the line 228.

Figure 4:
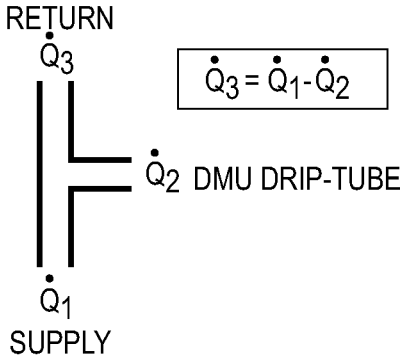
FIG. 4 is schematic representation of a release agent flow through a drum maintenance unit (DMU).

FIG. 4 illustrates a schematic diagram of the release agent apparatus 200 which can be viewed as an initial supply flow rate $\dot{Q}1$ of release agent over the supply line 208, a flow rate delivered to the DMU drip tube $\dot{Q}2$, the quantity of release agent consumed by the printer, and release agent return rate, $\dot{Q}3$, the flow rate of release agent moving along the return line 210. While $\dot{Q}2$ is the critical rate that must be controlled to maintain sufficient wetting of release agent, in addition to preventing ink offsetting failures, a determination of the $\dot{Q}2$ flow rate has been proven to be problematic to monitor cost effectively in-situ.

The present disclosure therefore determines a predicted and acceptable value of $\dot{Q}2$ from feed forward input information including printer conditions of image area coverage, metering blade age and web velocity. In addition, specifications for the supply pump 216 are utilized to assume the required supply flow rate $\dot{Q}1$. The required return flow rate $\dot{Q}3$, which is equal to $\dot{Q}1$ minus $\dot{Q}2$, is therefore determined based on the following equations. The flow rate $\dot{Q}2$ is, as described above, a function of percent area coverage, blade age, and engine speed as follows:

$$Q_{2=y}\left(\frac{\text{mg}}{\text{min}}\right) = f(\%\ AC, \text{Blade Age, Engine Speed}) = K_1((K_2 + 30)x_1 + (K_3 + 1{,}000))$$

Where:

$$x_1 = \%\ \text{Area Coverage}$$

The transfer function of y for the following conditions is as follows:

***Transfer function for 500*fpm* & NEW *DMU* blade***

$$y = mx_1 + b$$

$$y\left(\frac{\text{mg}}{\text{min.}}\right) = \frac{(4{,}000 - 1{,}000)}{100}x_1 + 1{,}000$$

$$y\left(\frac{\text{mg}}{\text{min.}}\right) = 30x_1 + 1{,}000$$

The variables of K1, K2 and K3 are determined as follows:

$$K_1 = \frac{\text{Print Speed}}{500} = \frac{x_3}{500}$$

Where:

$$x_3 = \text{Print Engine Speed } (fpm.)$$

$$K_2 = \text{slope correction} = \left(\frac{\Delta Y}{\Delta X}\right)x_2$$

$$K_2 = \text{slope correction} = \left(\frac{70 - 30}{1{,}000{,}000}\right)x_2$$

$$K_2 = \text{slope correction} = \frac{x_2}{25{,}000}$$

Where:

$$x_2 = DMU\ \text{Blade Age (in feet of web)}$$

$$K_3 = y - \text{intercept shift} = \left(\frac{\Delta Y}{\Delta X}(y_{int.})\right)x_2$$

$$K_3 = \left(\frac{3{,}000 - 1{,}000}{1{,}000{,}000}(1{,}000)\right)x_2$$

By calculating one or more values for $\dot{Q}2$ using the values of percent area coverage, blade age, and engine speed, a determination can be made for when the oil consumption rate falls within an acceptable range.

To determine whether the oil consumption rates falls within an acceptable range, the return mass flow rate of the release agent is monitored by the flow rate detector 224 of FIG. 1. As further diagrammatically illustrated in FIG. 5, the flow rate detector 224 is disposed at the outlet of the return line or conduit 210 which directs release agent into the oil supply sump 212. The flow rate detector of FIG. 5 includes a tube 230 operatively connected in line with the return line 210. The tube 230 is configured to include an output orifice 232 through which the surplus release agent flows. Because the tube 230 and the output orifice 232 each include a predetermined shape, the flow rate of the release agent exiting the output orifice 232 can be determined. As the release agent exits the output orifice 232, the flowing release agent contacts mechanical sensor including an arm 234 operatively connected to a torsion spring 236. The torsion spring 236 provides a predetermined spring resistance to the arm 234 such that the arm in the absence of being contacted by flowing release agent remains substantially perpendicular to the flow of release agent from the output orifice 232. A first end 238 of the arm 234, when contacted by flowing release agent 240, moves in a downward direction as illustrated. Since the arm 234 is spring biased around a pivot point 242, a second end 244 moves in an upward direction, as illustrated, into contact with high flow limit switch 246, thereby indicating that there is an excessive quantity of surplus oil being delivered to the spreader drum 132. If the flowing release agent 240 is, however, sufficiently low, a low flow limit switch 248 is contacted by the second end, thereby indicating that there is an insufficient quantity of surplus oil for wetting the spreader drum 132.

Each of the high flow limit switch 246 and low flow limit switch 248 is operatively connected to the controller 226. The opening and closing of the limit switches 246 and 248 provide an indication of the state of the limit switches to the controller to thereby indicate excessive or insufficient release agent. The controller 226 is configured to respond to either the high flow condition or the low flow condition by generating a signal indicative of a potential fault condition. The fault condition signal, in one embodiment provides an alert signal to a receiver 249 (see FIG. 1) to an operator which can either be visual alert signal appearing at a user interface, an alert sound, or both. In another embodiment, the controller 226 is configured to perform a printing system shutdown under controlled conditions to ensure that no further damage, if any, occurs.

The receiver 249 in different embodiments includes a computer user interface which is located at a personal computer, a laptop computer, a workstation or a printer user interface. In other embodiments the receiver 249 includes a land-line phone or a cellular phone. The transmitted alert signal in different embodiments results in an alert signal which includes a sound alert, a voice message, a text message, an instant message and an e-mail message, or other alerting messages or signals. Consequently, as described herein, the receiver is embodied in a receiving device which receives the transmitted alert signal and generates an alert message which indicates to a user that the printer requires an analysis to determine the presence of a fault condition resulting from an incorrect quantity of release agent being applied to the spreader.

Figure 5:
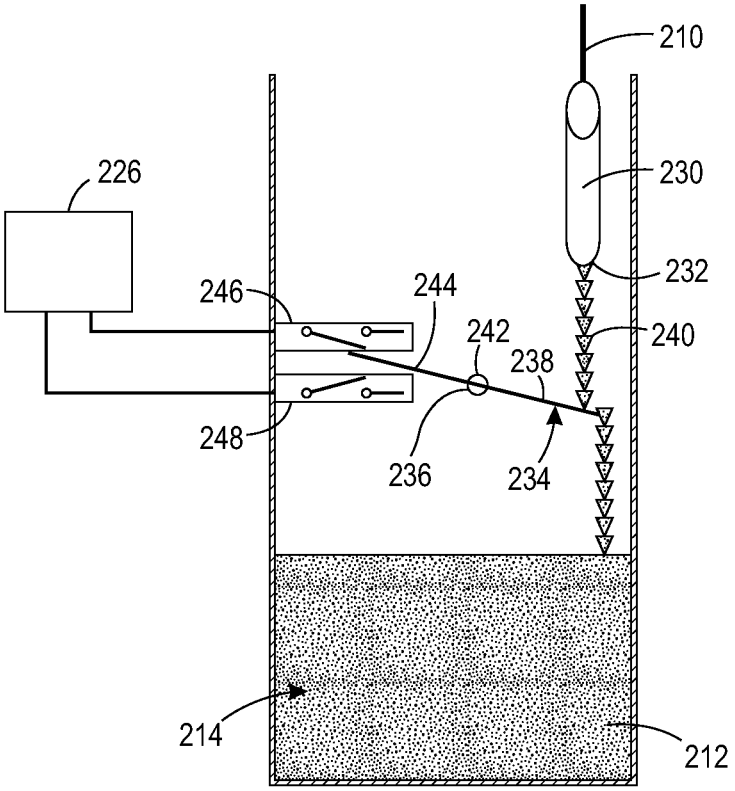
FIG. 5 is a schematic diagram of a portion of the release agent application system including a mechanical flow rate detector.

While a basic mechanical style sensor is illustrated in FIG. 5, any alternative sensing apparatus such as optical, inductive, or other types of sensor embodiments are utilized.

Figure 6:
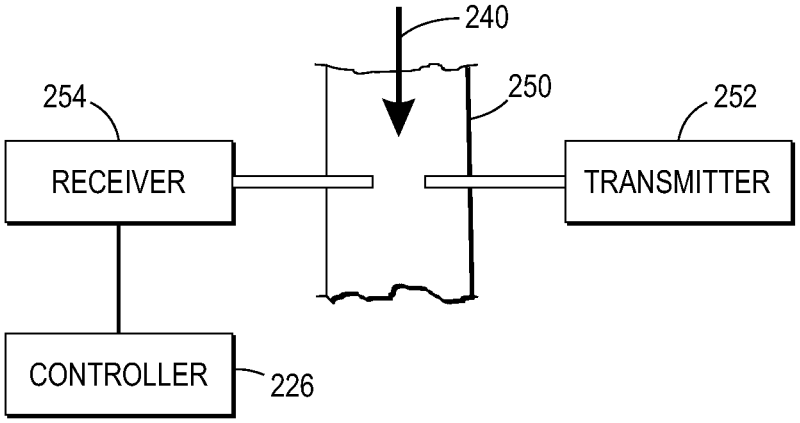
FIG. 6 is a schematic diagram of another embodiment of a portion of the release agent application system including an optical flow rate detector.

For instance as illustrated in FIG. 6, a support structure 250, a portion of which is shown, supports respective fiber optic cables extending from a fiber optic transmitter 252 and a fiber optic receiver 254. The fluid flow 240 is sensed by the fiber optic receiver 254 and transmits a signal to the controller 226 to which the receiver 254 is operatively connected.

Figure 7:
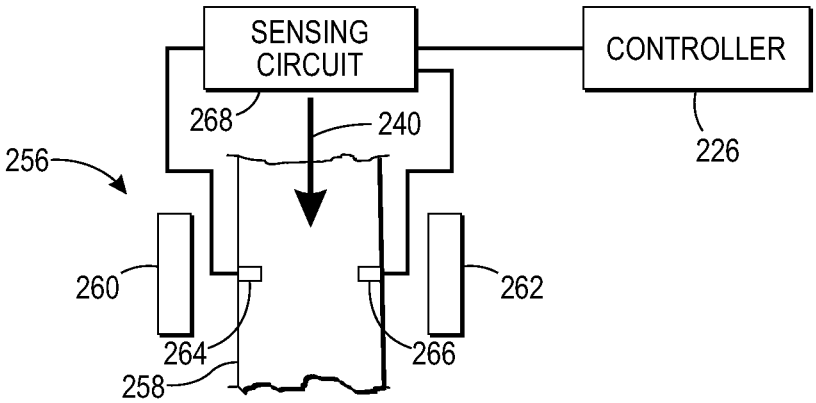
FIG. 7 is a schematic diagram of another embodiment of a portion of the release agent application system including an inductive flow rate detector.

FIG. 7 illustrates another embodiment of the flow rate detector 224. In this embodiment, an inductive flow rate sensing device 256 includes a support structure 258 disposed in line with the fluid flow 240. The support structure supports a first magnet 260 and a second magnet 262 configured to generate a magnetic field that passes through the fluid flow 240. The first magnet 260 and second magnet 262 are electromagnets producing a reversing magnetic field. A first electrode 264 and a second electrode 266 are supported about the fluid flow 240 by the support structure 258. The magnets induce a magnetic field which changes according to the flow rate of the fluid along fluid flow path 240. Each of the electrodes 264 and 266 are operatively connected to a sensing circuit 268 which provides a fluid flow signal indicative of the flow of fluid to the controller 226.

Sensing fluid flow in the return path 210 enables accurate, simple, cost effective implicit monitoring of release agent supply rate to the spreader drum surface. When the actual return flow rate is determined to be out of a normal operating range, the machine controller 226 can then initiate a warning message to the operator and/or perform a controlled printing system shutdown. The metering blade is then inspected and replaced, if necessary, and/or additional maintenance procedures are performed, if necessary, to restore the release agent supply system to proper operation. The release agent apparatus including the flow rate detector described herein greatly reduces the probability of the occurrence of a non-optimal supply of release agent to the spreader drum surface. The product failure rate caused by degraded durability performance or ink offsetting to the spreader drum is thereby reduced. Release agent delivery to the spreader drum and print media is optimized for best In-line coating performance.

Figure 8:
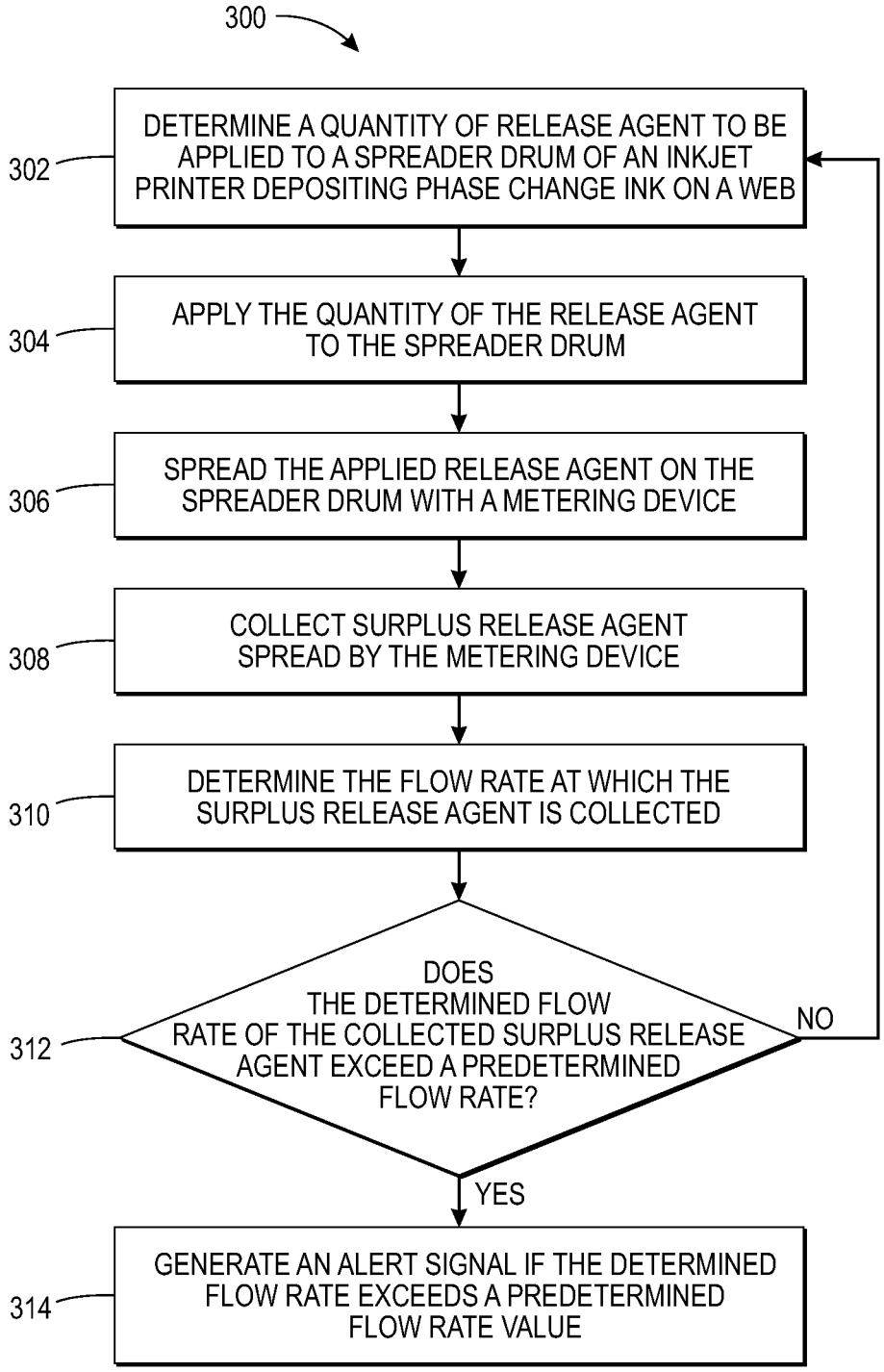
FIG. 8 is a block diagram of a process for determining whether a quantity of spreader agent applied to a spreader drum requires generation of an alert signal if a determined flow rate of spreader agent exceeds a predetermined flow rate of spreader agent.

FIG. 8 illustrates a block diagram 300 of a process for determining whether a quantity of spreader agent applied to a spreader drum requires generation of an alert signal if a determined flow rate of spreader agent exceeds a predetermined flow rate of spreader agent. In particular, the block diagram 300 describes a process in which a flow rate of a surplus quantity of release agent is determined to identify potential printer fault conditions. As illustrated in FIG. 8, a determination is made as to the quantity of release agent to be applied to a spreader drum of an ink jet printer (block 302). The determined quantity of release agent is applied to the spreader drum at block 304. Once applied, the applied release agent is spread on the spreader drum with a metering device (block 306). In one embodiment, the metering device is a metering blade.

Once the release agent has been spread on the spreader drum, surplus release agent is collected (block 308). At block 310, the flow rate of the collected surplus release agent is determined. To determine whether the printer is potentially subject to a fault condition due to excessive release agent, the determined flow rate $\dot{Q}2$ of the collected surplus release agent is compared to a predetermined flow rate (block 312). If the determined flow rate of the collected surplus release agent is not greater than the predetermined flow rate, the printer continues printing operations where release agent is applied at block 302. If, however, the determined flow rate is greater than the predetermined flow rate, an alert signal is generated to alert a user that a potential fault condition related to excessive release agent exists (block 314).

While in one embodiment, a "lower limit" is determined to provide an indication that too little release agent has been applied, in another embodiment, an "upper limit" is determined in which too much release agent has been applied. In still another embodiment, both a "lower limit" and an "upper limit" are determined to evaluate whether too little release agent or too much release agent has been applied. If the applied release is below the lower limit, hot ink offsetting to the spreader drum can occur. When the "lower limit" condition occurs, the fault in the system leading to too little release agent can result from a leak in the sump, a leak in tubing in the release agent apparatus connecting the sump to the release agent applicator, or improper operation of the pump. If too much release agent is applied to the spreading apparatus, the release agent application can be damaged or sufficiently worn to leave too much release agent on the spreader apparatus including the spreader drum. In this case, the release agent delivery rate to the spreader drum and print media is excessive and not optimized for best in-line coating performance. Consequently, when the collected release-agent indicates an "out-of-range" condition, an above the "upper limit" or below the "lower limit" condition, a fault condition is detected which disables at least one function of the inkjet printer or which generates an alert signal for review by a printer user.

It will be appreciated that variants of the above-disclosed and other features and functions, or alternatives thereof, can be desirably combined into many other different systems, applications or methods. Various presently unforeseen or unanticipated alternatives, modifications, variations or improvements can be subsequently made by those skilled in the art that are also intended to be encompassed by the following claims.

What is claimed is:

1. A printing system comprising:

a printhead configured to deposit phase change ink on a continuous web of recording media in response to image data as the continuous web moves through the printing system;

a spreading apparatus including a spreader drum and pressure roller defining a pressurized nip through which the continuous web moves to enable the phase change ink deposited by the printhead on the continuous web to contact the spreader drum and be fixed to the continuous web at the pressurized nip;

a release agent apparatus having a reservoir, a flow rate detector and a release agent dispenser, the reservoir being connected to a supply path to deliver a liquid release agent to the release agent dispenser for application to the spreader drum and the flow rate detector being disposed in a return path within the release agent apparatus to the reservoir and configured to generate a signal indicating a flow rate of liquid release agent returned to the reservoir from the spreader drum;

a metering device disposed adjacent the spreader drum, the metering device being configured to meter the liquid release agent applied to the spreader drum and direct liquid release agent from the spreader drum to the return path in the release agent apparatus to enable the flow rate of the liquid release agent returned to the reservoir to be compared to the predetermined threshold for generation of the alert signal; and a controller operatively connected to the flow rate detector to receive the signal from the flow rate detector, the controller being configured to identify a flow rate to the release agent dispenser with reference to a percent area coverage of the continuous web with the phase change ink, an age of the metering device, and a speed at which the continuous web moves through the printing system and to generate a signal indicating a fault condition in the release agent apparatus in response to the controller detecting the identified flow rate being greater than a predetermined threshold.

2. The printing system of claim 1, the flow rate detector further comprises:

an inductive sensor having a first electro-magnet and a second electro-magnet, each of the first electro-magnet and the second electro-magnet being configured to generate a reversing magnetic field in the return path through which the liquid release agent is returned.

* * * * *